United States Patent [19]

Takahashi

[11] Patent Number: 4,586,899

[45] Date of Patent: May 6, 1986

[54] GAS ATMOSPHERE HEATING FURNACE

[75] Inventor: Susumu Takahashi, Yokohama, Japan

[73] Assignee: Kanto Yakin Kogyo K.K., Japan

[21] Appl. No.: 629,000

[22] Filed: Jul. 9, 1984

[51] Int. Cl.[4] ..... F27B 9/00; F27B 7/00

[52] U.S. Cl. ..... 432/148; 432/194

[58] Field of Search ..... 432/128, 144, 148, 194

[56] References Cited

U.S. PATENT DOCUMENTS

| | | | |
|---|---|---|---|
| 1,838,143 | 12/1931 | Hoge | 432/148 |
| 2,949,869 | 8/1960 | Leeuwrik | 432/148 |
| 3,802,832 | 4/1974 | Nicolaus | 432/128 |
| 4,193,761 | 3/1980 | Mantegani | 432/128 |

*Primary Examiner*—John J. Camby

*Attorney, Agent, or Firm*—Shlesinger, Fitzsimmons & Shlesinger

[57] ABSTRACT

In a continuous heating furnace, particularly in a preheating chamber thereof, forced heat convections of an atmosphere gas are produced to heat articles rapidly. The convections which circulate transversely to a longitudinal axis of the furnace, retard an axial flow of the atmosphere gas. This retardation is lassened by having the convections flown portionally as branch streams toward an intake opening of the furnace by means of novel baffle plate or vane means which are provided in the preheating chamber so as to be outside a moving path of articles through the chamber and within circulating paths of convections.

3 Claims, 3 Drawing Figures

GAS ATMOSPHERE HEATING FURNACE

BACKGROUND OF THE INVENTION

This invention is to provide a heating furnace having such means which can adjustably control a flow of gas atmosphere within the furnace. More specifically, this invention is to provide, to a continuous gas atmosphere heating furnace consisting of a preheating chamber, a chamber for heat treatment such as brazing, and a cooling chamber, with means for adjustably controlling a flow direction and amount of an atmosphere gas which has been applied into the furnace and is circulated within one or both of the preheating and cooling chambers by fan means in a direction transverse to and substantially at a right angle with the longitudinal axis of the furnace so as to be repeatedly in contact with heating or cooling means in the chambers, heated or cooled thereby, and in contact efficiently with articles under the heat treatment.

A continuous gas atmosphere heating furnace of the kind mentioned above and as illustrated in FIG. 1 which shows as an example of this invention a heating furnace for brazing aluminum articles, employs a gas atmosphere of $N_2$ gas and so on of a high purity for the prevention of oxidation of aluminum articles and brazing materials applied thereto. In order to keep the purity of such gas atmosphere, the furnace employs a metallic muffle case, or inner walls of the furnace which are made from refractory materials, are lined with metals. In case of the furnace utilizing a muffle, the heating of a gas atmosphere and consequently of articles passing through said gas atmosphere is made indirectly by heating means which are located outside the muffle (the heating means could be bare in this instance). And, in case of the furnace, refractory inner walls of which are lined with metals, heating means such as a pipe heater which is not bare, has to be used. At any rate, the heating of articles to be treated depends primarily on radiation transmission of heat. Under such heating, however, it takes much time until the articles such as aluminum products having bright surfaces are heated to a desired temperature, because their surfaces has extremely low emissivity. When it takes much time to heat articles to a predetermined temperature, and consequently when the articles stay within a furnace gas atmosphere for a comparatively long period of time, outer surfaces of aluminum articles and brazing alloys applied thereupon tend to be oxidized even by a very trace amount of $O_2$ and $H_2O$ contained in the furnace gas atmosphere such as $N_2$ gas. Oxidation of the articles at their surfaces most adversely affects brazing thereof.

Under the circumstances, it is required, therefore, to heat the articles rapidly. And, in order to achieve this end, it has been proposed to heat the articles in a preheating chamber into which they are first introduced, not only by the aforementioned radiation transmission of heat but also by forced heat convection, medium of which is the furnace gas atmosphere such as $N_2$ gas. This kind of forced heat convection is produced in the preheating chamber by circulation fans provided at an elevated position in the chamber. In this instance, the gas atmosphere in the preheating chamber is circulated along planes in transverse and vertical to a longitudinal axis of the furnace or forwarding direction of articles within the furnace, and repeatedly makes contact with heating means which are provided outside a moving path of the articles, to be heated by the heating means and to heat the articles in turn. The gas atmosphere thus circulated along the above-mentioned vertical planes in the chamber does work, on one hand, as if it were pneumatic curtains extending transversely to the furnace. To wit, such vertically extending curtains of circulation gas bar the free flow of furnace gas atmosphere which slowly streams from a gas inlet to an intake opening of the furnace via heat-treatment and preheating chambers, and from the gas inlet to an outtake opening for articles via a cooling chamber. Since the gas atmosphere which has been introduced first to the heat-treatment chamber, heated and expanded therein, tends to be a kind of resistance against the above-mentioned free flow of furnace gas atmosphere, the vertical curtain-like circulation of gas further retards said free flow. This has to be avoided really. Retardation of the flow of atmosphere gas within the furnace chambers though it is slow, lowers high purity of the gas as it is not continuously refreshed. It shall be noted also that when the gas flows too much in a single direction, viz., toward the cooling chamber, being barred in the heating and/or preheating chambers, air is sucked from the other direction, viz., into the preheating chamber, whereby the atmosphere gas becomes impure.

BRIEF SUMMARY OF THE INVENTION

In view of the above and in order to eliminate drawbacks accompanied to conventional gas atmosphere heating furnaces of the kind mentioned above, this invention is to provide the furnaces with novel means which adjustably control the flow direction and amount of gas atmosphere. More concretely, in a heating furnace consisting of continuous chambers, one or more of which chambers are provided with fan means for generating forced heating or cooling vertical convections, there are provided, according to this invention, guide plates for producing branch flows, which are within paths of the convections, the guide plates being adjustable at their planes with selected angles against vertical planes of the convections so that the flow direction and amount of gas through the chamber are freely controlled as a whole toward one or both of intake and outtake openings for articles in the furnace.

DETAILED DESCRIPTION OF THE PREFERRED EMBODIMENT OF THE INVENTION

This invention shall be explained more in detail with reference to the accompanying drawing and with reference to the brazing of aluminum articles employing a furnace made in accordance with this invention.

Figure 1:
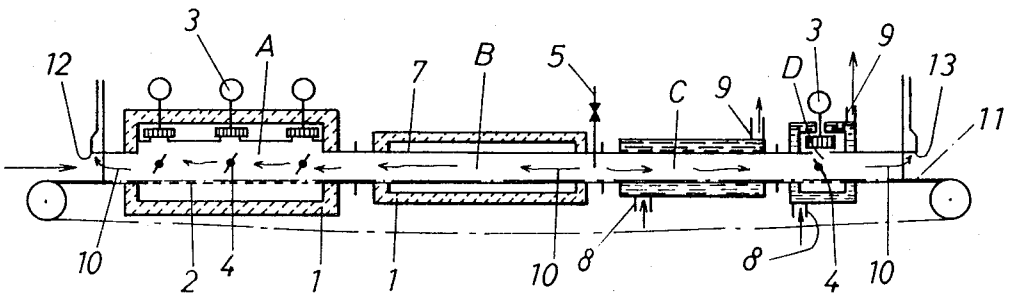
FIG. 1 is a vertical sectional explanatory view of a continuous heating furnace made in accordance with this invention.
Figure 2:
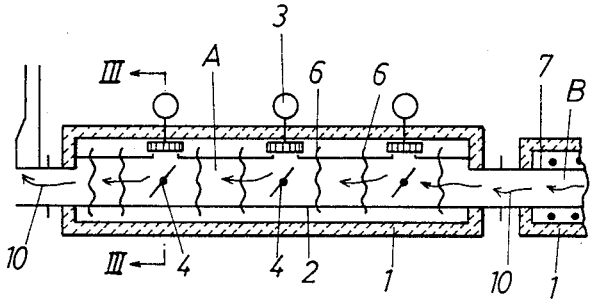
FIG. 2 is an enlarged explanatory sectional view of a preheating chamber of the furnace.
Figure 3:
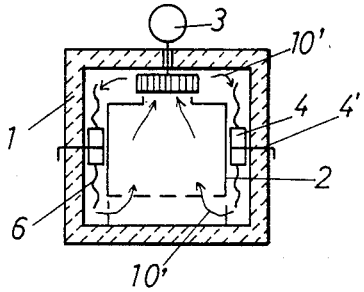
FIG. 3 is a section of the preheating chamber taken along the line III—III in FIG. 2.

A preheating chamber A, brazing chamber B, cooling chamber C, and forced cooling chamber D, housing walls 1 of which are respectively made from refractory or heat-insulating materials, are communicated each other. Though not shown specifically in the drawing, inner walls 1 of the preheating chamber A and the forced cooling chamber D are lined with metals. Numeral 2 indicates metallic baffle cases which are provided the chamber A and D so as to extend coaxially with said chambers, each one end of which is communicated with muffle cases 7, and sections of which are rectangular, same as the sections of the muffle cases and as best shown in FIG. 3. While the muffle cases 7 are completely sealed at their outer peripheries, the baffle cases 2 have at top and bottom walls thereof openings for having gas atmosphere circulated therethrough. Heating means which could be bare as aforementioned and which are provided in a space between the wall 1 of the brazing chamber B and the muffle case 7 for heating the gas atmosphere indirectly over the muffle case, are eliminated in the drawing for the simplicity thereof. And, in the preheating chamber A, there is provided heating means 6 which shall not be bare and be such as pipe heaters.

Numeral 3 indicates circulation fans which are provided in the preheating and forced cooling chambers A, D and above the top walls of baffle cases 2. Numeral 5 is an inlet which opens to the furnace, adjacently to the brazing chamber B for supplying an atmosphere gas into the furnace via the brazing chamber B. The furnace walls of the cooling chamber C and the forced cooling chamber D are cooled by the circulation of cooling water which comes into the walls from inlets 8 and comes out from the walls at outlets 9. And, numeral 11 indicates conveyor means which circulatingly pass through the baffle and muffle cases of the chambers A, B, C and D for the transportation of articles into and out of the furnace.

Under the above-explained constructions of the furnace, the articles which is first brought in the preheating chamber A, is rapidly preheated therein, further heated in the brazing chamber B to a predetermined brazing temperature and brazed, cooled in the chamber C, thereafter completely cooled in the forced cooling chamber D, and then discharged from the furnace. These heating and cooling of articles are made by gas atmosphere, flow directions of which are preferably to be as represented by arrows 10 in the drawing. However, the gas atmosphere is hard to flow in the directions 10. To wit, the atmosphere gas which has been first introduced into the muffle 7 of the brazing chamber B and into the muffle case 7 of the cooling chamber C, is heated and expanded in the brazing chamber, while it is cooled in the cooling chamber C, whereby the expanded gas in the brazing chamber B works as a resistance against the flows 10, and whereby the atmosphere gas tends to flow much toward an outtake opening 13 of the furnace through the cooled chambers C and D. The flow of gas thus inclined to flow much in one direction invites the suction of air at the other direction, resulting in making the air impure.

The flow of gas 10 toward an intake opening 12 of the furnace is further retarded in the preheating chamber A. That is, the flow of gas 10 is generally changed in the preheating chamber A to a circulation flow which is represented by numeral 10' for producing forced heat convections. This forced heat convections 10' constitute streams which are in transverse to the longitudinal axis of baffle case 2 substantially with a right angle thereto. In order words, the circulating streams 10' work as if they were vertical curtains standing in the way of the preferred flow of gas 10.

In this invention, as best shown in FIG. 3, there are provided at spaces between the walls 1 of the preheating and forced cooling chambers A, D and the baffle cases thereof those guide plates 4 which are for producing branch flows within the circulation flows 10'. The guide plates 4 for producing the branch flows extend along a plane transverse to the longitudinal coaxial lines of the preheating and forced cooling chambers A and D, and can be inclined about shafts 4' thereof to a desired angle between a vertically erected position where the plane of plate 4 extends transversely to the above-mentioned longitudinal coaxial lines with a right angle thereto and a position where the plane of plate 4 lies down in parallel with said longitudinal coaxial lines. The guide plates 4 at the vertically erected position give substantially no effects on the flow 10', because the planes of plates are in parallel with said flow. However, when the plates 4 are kept slanted, a part of the flow 10' changes into branch streams running toward the intake opening 12 and in transverse to the said flow 10'. Consequently, the gas atmosphere in the furnace is led as a whole in arrow directions represented by numerals 10.

In order to know how gas flows in a heating furnace for brazing works made in accordance with this invention, following four examples are given, in which a dew point of the gas atmosphere was measured for an indication of purity of the gas passing through the chambers.

EXAMPLE 1

$N_2$ gas having a dew point of −68° C. was supplied into the furnace from the gas inlet 5 at a velocity of 50 $m^3$/hour, while the preheating chamber A was kept at 520° C. and the brazing chamber B at 610° C. The branch flow-forming guide plates 4 were kept, of effective planes thereof, in the directions which are in transverse with the longitudinal axis of the furnace (that is, in the direction in parallel with the planes of streams 10', wherein the plates 4 are ineffective to said streams).

The dew point of gas atmosphere in the brazing chamber B was measured as −38° to −42° C., which showed that the flow 10 had directed much toward the outtake opening 13.

EXAMPLE 2

The plates 4 in the preheating chamber A were kept slanted toward the intake opening 12 so that a ratio between an outlet flow of gas from the intake opening 12 and that from the outtake opening 13 was about 2:1. The dew point of atmosphere gas 10 in the brazing chamber B became lowest in this instance, that is, −55° C. to −62° C. The flow of gas was recognized as a whole as represented by the arrows 10.

EXAMPLE 3

The plates 4 were kept slanted as in Example 2. The dew point of gas in the brazing chamber B was sustained below −50° C., even when the supplying velocity of $N_2$ gas was reduced to 35 $m^3$/hour. This means that $N_2$ gas at a low velocity could make smooth flows 10 on account of provisions of plates 4.

EXAMPLE 4

The furnace was kept under the same conditions as in Example 3. Ten pieces of aluminum articles each having a weight of 3 Kg. were brazed. Excellent brazing was attained. The dew point of atmosphere gas $N_2$ in the brazing chamber B was −48° to −54° C.

These examples show that on account of the vane means 4 which are simple in their constructions, gas flow or streams in the furnace can be readily and adjustably controlled, and desired purity of the gas flows is easily maintained. In addition, the consumption of atmosphere gas can be reduced without adversely effecting the brazing or heating performance by a furnace.

I claim:

1. In a continuous heating furnace having means for conveying articles in a predetermined path successively through a plurality of chambers, each having an inlet and an outlet, and being formed in the furnace to communicate with each other, and within at least one of which chambers the articles pass through a baffle casing, which is mounted in said one chamber in spaced relation to the walls defining said one chamber, and wherein an atmosphere gas passing longitudinally through said one chamber is forced also to be circulated as a heating or cooling gas convectionally along a flow path extending substantially transversely of the longitudinal axis of said one chamber, the improvement comprising plate means positioned in said one chamber outside said predetermined path of travel of the article conveyed through said one chamber and within said flow path of the forced gas, said one chamber being a preheating chamber communicating with the inlet to an adjacent heat-treatment chamber, and said plate means being mounted in said space between the walls of said preheating chamber and said baffle casing for adjustment between one position in which said plate means extends substantially parallel with said flow path of the forced heating or cooling gas, and another position in which said plate means extends substantially transversely of said flow path.

2. A continuous heating furance as claimed in claim 1, in which another of said chambers is a forced cooling chamber communicating with the outlet of said heat-treatment chamber via a preliminary cooling chamber, and a further baffle casing is mounted in said forced cooling chamber in spaced relation to the surrounding walls of said forced cooling chamber, and further plate means are provided in said space between the walls of the forced cooling chamber and said further baffle casing.

3. A continuous heating furnace as claimed in claim 2, including means for feeding said atmosphere gas into said furnace between said heat-treatment chamber and said preliminary cooling chamber, the first-named plate means being operable to cause a portion of the gas from said feeding means to flow successively through said heat-treatment chamber and said preheating chamber, and said further plate means being operable to cause another portion of said gas from said feeding means to pass successively through said preliminary cooling chamber and said forced cooling chamber.

* * * * *